United States Patent [19]

Faraudo et al.

[11] Patent Number: 4,598,500

[45] Date of Patent: Jul. 8, 1986

[54] DUST COLLECTOR FOR AIR SANDER

[76] Inventors: Julio P. Faraudo, 3498 Mendocino Ave.; Frank A. Faraudo, 1228 Janero Dr., both of Santa Rosa, Calif. 95401

[21] Appl. No.: 761,741

[22] Filed: Jul. 31, 1985

[51] Int. Cl.[4] ..... B24B 55/06

[52] U.S. Cl. ..... 51/273; 51/170 TL

[58] Field of Search ..... 51/273, 170 R, 170 MT, 51/170 TL, 174, 175; 15/22 C

[56] References Cited

U.S. PATENT DOCUMENTS

| | | | |
|---|---|---|---|
| 2,565,658 | 8/1951 | Hilger | 51/177 |
| 2,929,177 | 3/1960 | Sheps | 51/273 |
| 3,638,362 | 2/1972 | Stoll | 51/170 MT |
| 3,932,963 | 1/1976 | Hutchins | 51/170 TL |
| 4,296,572 | 10/1981 | Quintana | 51/273 |
| 4,381,628 | 5/1983 | Dicke | 51/170 TL |

*Primary Examiner*—Roscoe V. Parker

*Attorney, Agent, or Firm*—Owen, Wickersham & Erickson

[57] ABSTRACT

A device adapted to be attached to a power sander for confining and removing dust and debris during operation of the sander. The device comprises a cover that fits over and conforms to the sander shape with surrounding wall members whose lower edge is in the same plane as the sander's movable platen. An outlet opening at one end of the device is connectable to an air vacuum machine and interior walls form elongated air passages along opposite sides of the movable sander platen to facilitate efficient air flow and dust removal.

6 Claims, 4 Drawing Figures

DUST COLLECTOR FOR AIR SANDER

This invention relates to a cover device for a motorized grinding, cutting or sanding tool.

BACKGROUND OF THE INVENTION

Abrasive power tools such as grinders, cutters and sanders inherently create large volumes of dust when in use which can be detrimental not only to operating efficiency but also to personnel in the area. To alleviate this problem the prior art has provided various forms of power tools with built-in dust removal capabilities. Such prior art includes U.S. Pat. Nos. 3,638,362; 3,932,963 and 4,381,628. However, literally millions of power sanders and the like have been and are being manufactured which have no dust-control capabilities. For example, one common form of sander used extensively in the auto repair business is a sander having an oscillating platen which is pneumatically driven. When such a sander is used for removing old paint or in smoothing plastic reconstructive material, often called "bondo", a tremendous volume of dust is created and must be removed or tolerated in some way. The present invention provides a highly effective and economical solution to this problem.

Accordingly, it is one object of the present invention to provide a removable cover device for a power sander that provides a means for confining and removing the dust created by the sander and thereby preventing it from entering the atmosphere surrounding it when in use.

Another object of the present invention is to provide a one-piece cover device for a sander which extends over and around it to serve as a guard as well as a dust collector.

A more specific object of the invention is to provide a one-piece cover device for a power sander that surrounds the oscillating sander platen and causes air to circulate within the device to remove dust and abrasive particles efficiently when connected to an air vacuum system.

Still another object of the present invention is to provide a dust removing cover for a sander that is particularly well adapted for ease and economy of manufacture.

Another object of the present invention is to provide a cover for a power sander which is easy to install and which is highly durable and yet relatively light so that it does not reduce the operability and effectiveness of the sander.

SUMMARY OF THE INVENTION

In accordance with the present invention, a cover device preferably made of a suitable plastic material is shaped to conform with and fit around the body of a conventional pneumatic oscillating sander. Such a sander is generally elongated and has a rectangular shaped platen for holding a piece of abrasive material such as sandpaper. This platen is mounted for back and forth reciprocating movement within a surrounding frame or lower body structure. An oscillating pneumatic cylinder is located in an upper housing section above the platen and is linked thereto by a suitable drive means. Extending from one end, the upper housing is a handle grip and at the other end thereof is a removable knob. The cover device according to the invention fits partially over the upper housing section and completely covers the lower housing section by means of connected sidewalls and end walls that form a continuous barrier around the sander. The lower edge of this barrier terminates at a flange whose lower edge surface is in the same plane as the underside of the platen. Spaced inwardly from each cover sidewall is an interior wall member that fits adjacent to the sander. These interior wall members form a pair of elongated air passages along the side of the cover device that are open at opposite ends to the space inside the barrier. Extending from one end of the cover device is a conduit stub which is connectable to a suitable air hose that can be attached to an air vacuum device. When the sander is in use with the cover device in place, all of the dust created during sander operation is confined within the cover sidewalls and end walls. Air drawn by a vacuum force at the outlet causes a circulation through the side passages and around the oscillating platen thereby constantly removing all dust and particles that are created by the sander.

Other objects, advantages and features of the invention will become apparent from the following detailed description of one embodiment thereof, taken in conjunction with the accompanying drawing.

DETAILED DESCRIPTION OF EMBODIMENT

Figure 1:
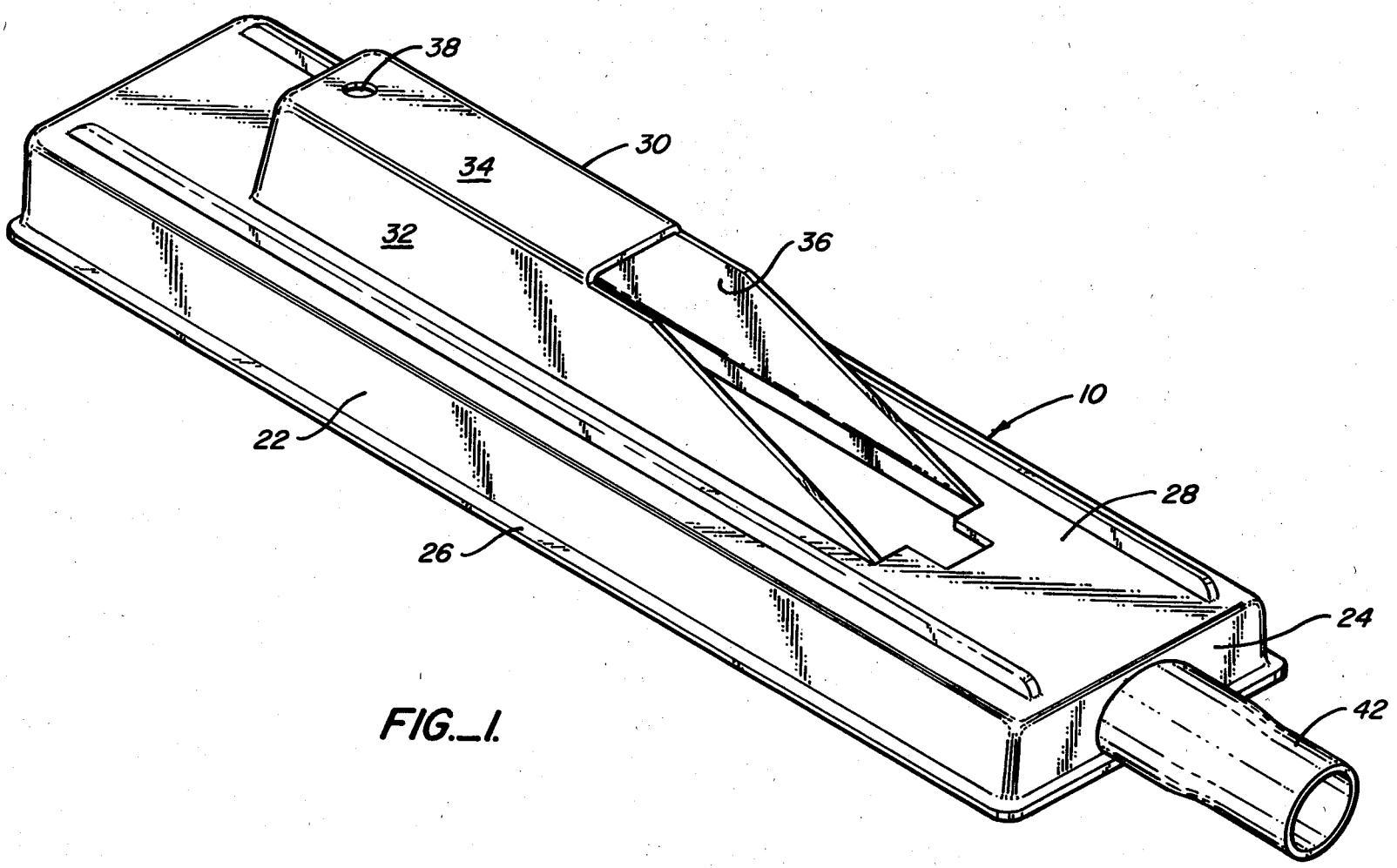
FIG. 1 is a view in perspective of a cover device according to the present invention.
Figure 4:
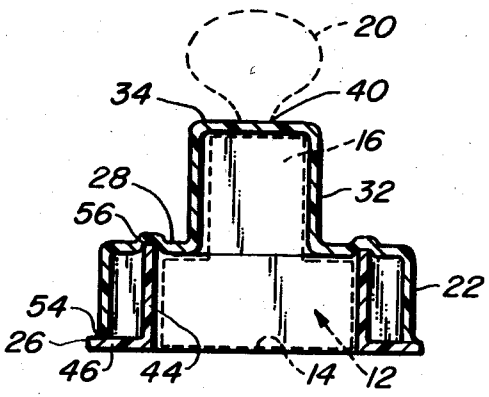
FIG. 4 is a view in section of the cover device, taken along line 4—4 of FIG. 1.
Figure 2:
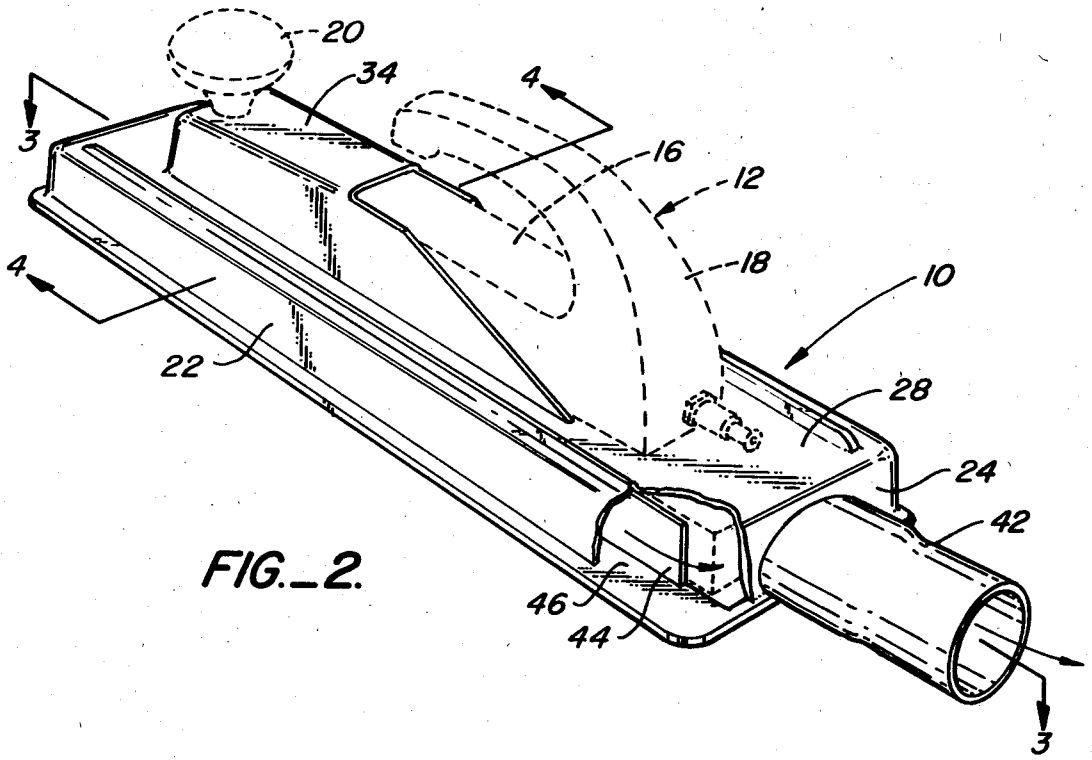
FIG. 2 is another view in perspective of the cover device according to the present invention, with a typical power sander shown in phantom and with a portion broken away to show interior structure.
Figure 3:
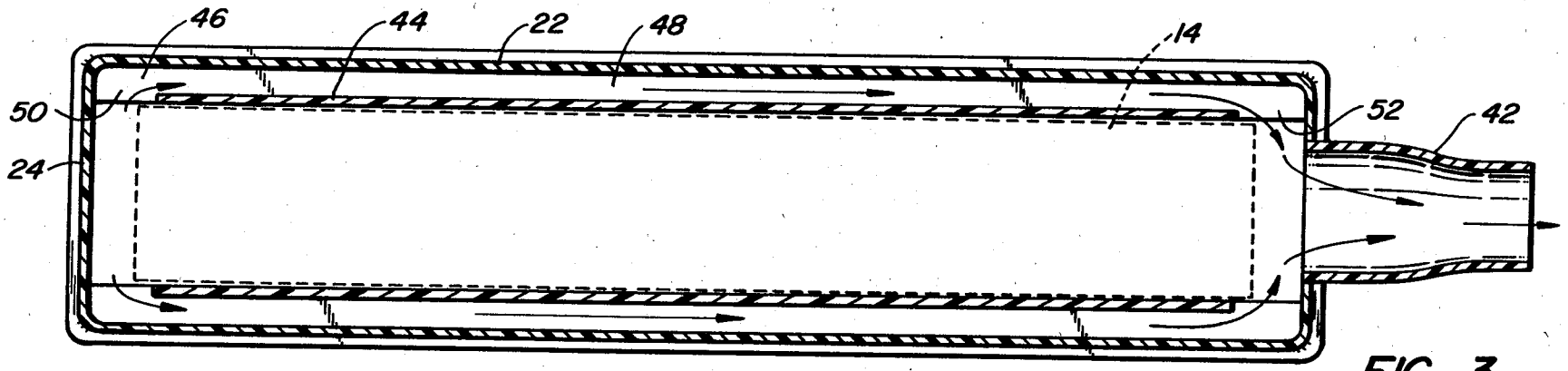
FIG. 3 is a view in section of the cover device, taken along line 3—3 of FIG. 1, with the sander shown in phantom.

With reference to the drawing, FIG. 1 shows a dust controlling cover device 10 for a power sander 12 of the type shown in phantom in FIGS. 2–4. Such sanders, which are commercially available, have a pneumatically driven platen 14 to which the abrasive media such as sandpaper is attached. The platen is essentially rectangular and is oscillated back and forth in its longitudinal direction by means of a linkage (not shown) that interconnects it with the pneumatic piston. Attached to one end of an upper housing 16 which supports the pneumatic piston is a rear handle 18 that is normally gripped by one hand of the operator. A removable knob 20 is provided at the other end of the upper housing which the operator normally grasps with his other hand. Without the cover device 10 of the present invention attached to the sander 12, a large amount of dust and debris is continuously created and permeates the surrounding atmosphere as the sander is used. Such dust and debris can be particularly noxious when the sander is used for smoothing plastic or "bondo" commonly used in body and fender car repair.

As shown in FIG. 1, the dust controlling device 10 is shaped to fit over the sander 12 and essentially surround its oscillating platen. Thus, the device has opposite sidewalls 22 and end walls 24 that are interconnected at their corners to form a continuous barrier. Along the lower edge of these barrier walls is a flange 26 whose bottom surface is essentially in the same plane as the bottom of the sander platen. Integral with and extending from the top of the barrier walls, is a transverse portion 28 which is spaced above the movable platen and its supporting structure on the sander. Within the cover area is a further raised cover portion 30 which has sidewalls 32 and a connecting top portion 34 adapted to fit fairly snugly around the sander's upper housing 16. An elongated opening 36 is provided in the raised cover portion to enable the device 10 to pass over the rear handle 18 when it is installed on the sander. A circular opening 38 is also provided near the forward end of the raised cover portion 30 to accommodate a threaded stud 40 for holding the removable knob 20 on the sander.

In the rear end wall of the barrier, is an opening to which is attached a short tubular outlet member 42 which can be readily coupled to a flexible air hose (not shown).

As shown in FIG. 3, the barrier of the device 10 surrounds the sander platen 14, and spaced inwardly from each barrier sidewall 22 is an interior wall member 44. The bottom edge of each interior wall member is attached to a bottom strip member 46 that is an interior extension of the flange 26. The top edge of each interior wall member is connected to the transverse cover portion 28. Each interior wall member is shorter in length than its parallel sidewall, thereby providing an elongated air passage 48 on each side of the device 10 with openings 50 and 52 at the front and rear ends to the interior of the device.

In constructing the cover device 10, the barrier sidewalls and end walls 22 and 24, the transverse portion 28 and the raised portion are preferably all formed together as a main integral component, using conventional plastic molding procedures. Each interior wall member 44 and its associated bottom strip member 46 is formed as a secondary component having a right angle cross-section, as shown in FIG. 4. These secondary members are then attached to the main component using a conventional plastic bonding material along the lower edge 54 of the sidewalls 22 and along the elongated recess 56 of a bead that extends above the transverse portion 28.

When the device 10 is installed on the sander 12, such as one shown in FIGS. 2-4, the forward knob 20 is temporarily removed and the device is merely placed over the sander so that the rear handle 18 can project through the elongated opening 36. With the device 10 properly in place on the sander, the lower flange 26 of the barrier sidewalls is flush with the underside of the sander platen 14. As shown in FIGS. 3 and 4, the interior wall members 44 are located adjacent to but spaced only a short distance away from the side edges of the platen. The length of the barrier sidewalls is such that ample clearance is provided to accommodate the oscillating longitudinal stroke of the platen. Before operation of the sander 12, an air hose from a suitable vacuum source is connected to the outlet fitting 42. As air flows through the device 10 to the vacuum source, the elongated passages 48 on both sides of the device provide for an ample volume of air flow. Thus, dust and debris created by the sander is kept within the barrier walls and is ultimately entrained in air that flows through the side passages 48, the end opening 50 and ultimately out the end opening 52 and the outlet 42.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A cover device for a generally elongated power sander having a body with forward and rearward handle means and an oscillating platen, said device being adapted to confine and remove dust and debris particles from the sander during its operation, and comprising:

a main body having a transverse member with sidewalls and end walls forming a barrier means that surrounds the sander platen and having openings to accommodate said handle means;

a pair of internal wall means forming elongated air passages within said barrier means and adjacent the sides of said sander platen, said elongated air passages being open at their opposite ends to spaces between the inside of said barrier means and the ends of said sander platen to facilitate the flow of air and entrained particles from said sander; and outlet means at one end of said barrier means adapted for connection with a conduit attached to an air vacuum source.

2. The cover device as described in claim 1 including an upper housing portion extending above said transverse portion and having upper sidewalls and an upper transverse portion adapted to fit adjacent to an upper body portion of said sander.

3. The cover device as described in claim 2 wherein said upper housing portion has a pair of spaced apart openings to accommodate said handle means of said sander.

4. The cover device as described in claim 1 wherein said internal wall means comprises a vertical wall member parallel to and spaced from each said barrier sidewall and a horizontal member extending from the bottom edge of said vertical wall member and connected to the adjacent barrier sidewall.

5. The cover device as described in claim 1 wherein said outlet means is a tubular member extending from a said barrier end wall around an opening therein.

6. The cover device as described in claim 4 wherein said cover device is fabricated from a first molded plastic component comprising said main body and from second and third members comprising said internal wall means which are bonded to said first component.

* * * * *